US006044761A

United States Patent [19]

Hecht

[11] Patent Number: 6,044,761

[45] Date of Patent: Apr. 4, 2000

[54] COATING PLATE FOR USE IN LITHOGRAPHIC AND OTHER TYPES OF PRINTING PRESSES

[76] Inventor: Myer H. Hecht, 1429 Central Ave., Deerfield, Ill. 60015

[21] Appl. No.: 09/065,297

[22] Filed: Apr. 23, 1998

Related U.S. Application Data

[62] Division of application No. 08/734,625, Oct. 18, 1996, Pat. No. 5,771,809.

[51] Int. Cl.[7] ..... B41N 1/12; B41N 10/02

[52] U.S. Cl. ..... 101/395; 101/375

[58] Field of Search ..... 101/395, 401.1, 101/481, 485, 486, 375, DIG. 36; 156/247, 248; 428/40.1, 42.3; 434/88; 118/46

[56] References Cited

U.S. PATENT DOCUMENTS

| | | | |
|---|---|---|---|
| 3,616,178 | 10/1971 | Gurin et al. | 101/401.1 |
| 3,619,335 | 11/1971 | Bryan | 101/467 |
| 3,889,397 | 6/1975 | Flood | 434/88 |
| 5,084,095 | 1/1992 | Fritz | 101/491 |
| 5,094,164 | 3/1992 | Kowalczyk et al. | 101/401.1 |
| 5,240,539 | 8/1993 | Gunzelman et al. | 156/248 |
| 5,535,677 | 7/1996 | Fannin et al. | 101/216 |
| 5,566,618 | 10/1996 | Frazzitta | 101/401.1 |
| 5,713,288 | 2/1998 | Frazzitta | 101/401.1 |

*Primary Examiner*—Stephen R. Funk

[57] ABSTRACT

A coating plate is provided for use in applying a coating material over selected areas of printed material produced in lithographic, flexographic, letterpress, or other types of printing presses. The coating plate is formed of a light-transmitting sheet-form carrier and a light-transmitting sheet-form applicator adhesively affixed to the carrier by a pressure-sensitive releasable adhesive. In preparing the coating plate for use in applying a coating to selected areas of printed material, a pattern sheet is provided with indicia indicating the selected areas of the printed material to be coated. The pattern sheet is placed under the coating plate. Utilizing the indicia of the pattern as a guide, the operator utilizes a knife or other suitable cutting instrument to cut through the applicator sheet around the areas indicated by the pattern sheet to be utilized as coating areas. The areas of the applicator sheet surrounding the areas of the coating sheet which are to be utilized as coating areas are then lifted off the coating plate and discarded. The coating plate is then mounted on a coating cylinder of the press, a coating material applied to the applicator sheet, and the coating material applied by the remaining portions of the applicator sheet to the printed material in the predetermined selected areas.

10 Claims, 2 Drawing Sheets

COATING PLATE FOR USE IN LITHOGRAPHIC AND OTHER TYPES OF PRINTING PRESSES

RELATED APPLICATION

The present application is a Division of application U.S. Ser. No. 08/734,625, filed Oct. 18 1996, now U.S. Pat. No. 5,771,809 both Applications being of the present inventor Meyer H. Hecht.

BACKGROUND OF THE INVENTION

1. Technical Field

The present invention relates to the lithographic printing art, and more particularly refers to a coating plate utilized in coating selected areas of printed material produced by a lithographic printing press.

2. Background Art

In the lithographic printing art the lithographic press applies printing ink on sheets of paper, paperboard, plastic, or other materials to form printed matter in the form of text, logos, or patterns of various sorts. After the printed matter is formed, either after the ink has dried, or even before, it is conventional to apply a coating over selected areas of the printed sheet. This process is generally termed spot or pattern coating. Spot coating constitutes applying a coating in small areas surrounded by a lack of coating in large surrounding areas. Alternatively, a coating, termed "pattern coating", may be applied in large areas, and with the absence of coating in small selected areas. The coating may be applied for various reasons. In some instances the coating may be applied to protect the printed material. In other cases a coating may be applied to the printed material while the ink is still wet or tacky to prevent its sticking to other sheets when placed in a pile of sheets. The coating also provides better scuff resistance. The coating may also be applied to selected areas for aesthetic reasons. For example, it is sometimes desired to provide gloss to certain areas of the sheet in order to provide highlighting, while leaving other areas dull. Additionally, when certain areas of printed folding cartons must be coated with an adhesive, it is desirable or necessary to avoid coating the areas that contain the adhesive. Consequently, pattern coating is used to avoid those areas.

As commonly used in one method of the prior art, the coating process is accomplished by mounting a composite rubber/fabric blanket on a metal coating cylinder. A pattern is then printed onto the surface of the rubber blanket with printing ink, designating the areas to be coated and the areas to remain uncoated. An operator of the press crew then takes a knife or razor blade and cuts away all the areas where there is no ink, all the way down to a layer of fabric in the composite blanket. This process is expensive and takes considerable time. The cost of the rubber mat is considerable. Additionally, while the cutting of the rubber mat is taking place, the press is down. The cutting away of the portions of the rubber mat can take from one half hour to two hours. Press time is generally rated at from $200 to $600 per hour. It is clear that the cost of preparing a coating plate can become a real burden, particularly for small shops generally having a preponderance of short run jobs, where preparation time can be as long as, or longer than, run time.

SUMMARY OF THE INVENTION AND ADVANTAGES

According to the present invention, a coating plate (10) for coating selected areas of a printed sheet of other printed materials produced by the lithographic printing process is provided, comprising a light-transmitting carrier sheet (12), and a light-transmitting applicator sheet (14) adhesively affixed to the carrier (12) sheet by means of a light-transmitting releasable pressure-sensitive adhesive (16). In preparing the coating plate (10) for coating printed sheets in selected areas, a pattern which is provided with indicia to show the selected areas of the printed material to be coated is placed under the coating plate (10). As the operator views the pattern through the coating plate (10), he utilizes a knife or razor blade to cut through the applicator sheet (14) in conformity with the indicia of the pattern. The areas of the applicator sheet (14) surrounding the areas which are to remain as the coating pattern are then lifted away from the carrier (12), and the coating plate (10) thus processed and retaining the selected areas of the applicator sheet (14) which remain, is mounted on a coating roll. During the coating process, on-press, a coating liquid is applied to the applicator sheet (14), and, as the coating cylinder is rolled over the printed material, the remaining portions of the applicator (14) coat the printed material in the selected areas.

The present coating plate (10) has many advantages over the prior art coating plates, among which are very low material cost and much shorter preparation time, the preparation time being accomplished in-plant and away from the printing press, thereby requiring considerably less shutdown time of the lithographic presses.

BRIEF DESCRIPTION OF THE DRAWINGS

Other advantages of the present invention will be readily appreciated as the same becomes better understood by reference to the following detailed description when considered in connection with the accompanying drawings, wherein.

DETAILED DESCRIPTION OF THE PREFERRED EMBODIMENTS

Figure 1:
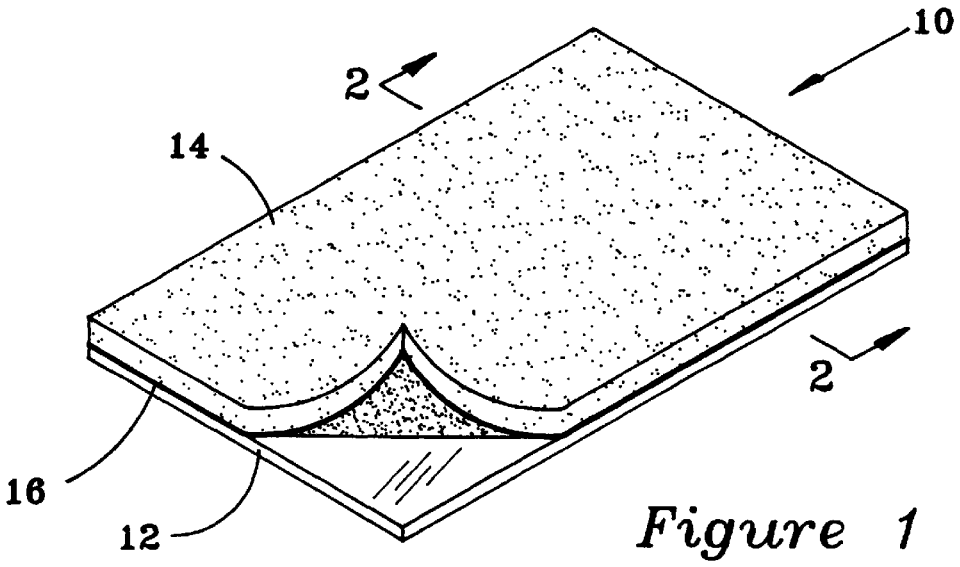
FIG. 1 is a perspective view of a coating plate (10) according to the invention, showing one corner of the applicator sheet (14) peeled away from the carrier sheet (12).
Figure 2:
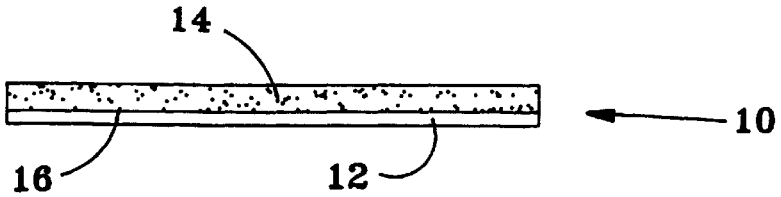
FIG. 2 is a cross-sectional view taken at the line 2—2 of FIG. 1.

Referring to FIGS. 1 and 2, a coating plate (10) according to the invention is shown comprising a carrier sheet (12) and an applicator sheet (14) adhesively affixed to the carrier sheet (12) by means of a releasable adhesive (16).

The carrier sheet (12) may be formed of any of a number of light-transmitting polymer sheets, among which are polyethylene, polystyrene, polyvinyl chloride, polyurethanes, polyepoxides, and polyesters. It is necessary that the polymer sheet be strong, durable, dimensionally stable, non-separatable, and sufficiently flexible to be placed on a cylindrical roll. It is also necessary that the material be uniform in thickness and light-transmitting. The preferred material is MYLAR®, a trademarked polyester manufactured and marketed by E.I. DuPont de Nemeurs, and having the chemical composition polyethylene terephthalate. Another suitable material is MELLIN EX®, a trademarked polyester manufactured and marketed by I.C.I. The carrier sheet (12) may be of any suitable thickness suitable to withstand the rigors of coating a large number of printed sheets. The carrier sheet (12) should have a thickness in the range of about 0.004" to about 0.020", and preferably in the range of about 0.010" to about 0.014". Carrier sheets (12) prepared from 0.010" thick MYLAR or 0.010" thick MELLIN EX® have been found to be the preferred embodiments.

The applicator sheet (14) may be formed of any suitable polymer sheet such as polyethylene, polyvinyl chloride, polystyrene, polymethyl methacrylate, polyepoxides, polyurethanes, and many other similar polymeric materials. It is necessary that the polymer sheet used in forming the applicator sheet (14) be of uniform thickness and light transmitting, in order that a pattern placed under the coating plate (10) may be readily observed through the coating plate (10). It is also necessary that the surface energy of the outer surface of the applicator sheet (14) have a sufficiently high surface energy so that a coating liquid placed thereon is retained in sufficient amount, and wherein most of the coating liquid is subsequently transferred to the selected areas of the printed sheet. When a material is utilized which does not in its natural state have a sufficiently high surface energy, the surface energy can be materially increased by treatment of the surface by well known methods such as corona discharge, high voltage treatment or high temperature treatment. It has been found that a polymeric sheet having a surface energy of at least 32 dynes per square centimeter, and preferably at least 38 to 40 dynes per square centimeter is highly suitable for use as the applicator sheet (14). Suitable materials are polyvinyl alcohol, polyethylene, polystyrene, polyacrylates such as polymethyl methacrylate, as well as other polymers and copolymers of acrylates such as methacrylates and ethacrolates, polyurethanes, and polyepoxides. In order to be suitable for the present invention, the sheet of the material must be light-transmitting, that is, transparent or translucent. If the sheet of material is translucent, it should be sufficiently light-transmitting so that a pattern placed under the coating plate (10) can be viewed through the coating plate (10) sufficiently to enable the applicator sheet (14) to be cut according to the indicia (22)(24)of the pattern sheet 26. Polyvinyl chloride and polyethylene sheets have been found to be particularly desirable for use as the applictor sheet (14). The applicator sheet (14) should have a thickness in the range of about 0.015" to about 0.040", and preferably in the range of about 0.018" to about 0.025".

The coating plate (10) of the invention may be prepared in any of several ways. A releasable light-transmitting pressure-sensitive adhesive (16) may be applied to he carrier sheet (12) or to the applicator sheet (14), or to both, by means such as brushing or spraying, or other means commonly used in the art. The two sheets are then placed together to cause them to adhere to each other. Because the adhesive is releasable, and is not setting, unwanted sections of the applicator sheet (14) may then be cut and removed from the carrier sheet (12), leaving only the portions which are to apply coating to selected areas of the printed material.

In a preferred method for fabricating the preferred embodiment of the coating plate (10) of the invention, the applicator sheet (14) is purchased under the trade name SYROM EASY-LAC 22, marketed by the OxyDry Corporation located in Itasca, Ill. This product is received in the form of a sheet of material represented by the supplier to be polyvinyl chloride. It is obtained in the form of a sheet having a thickness of 0.020", having a light-transmitting pressure-sensitive adhesive approximately 0.001" on one surface and a removable protective backing covering the adhesive. The polymeric sheet is represented to have a surface energy of at least about 38 dynes per square centimeter.

In completing the fabrication of the coating plate (10), the protective backing is removed from the polymer sheet, and the polymer sheet is pressed onto the carrier sheet (12). The polymer sheet then becomes the applicator sheet (14). The carrier sheet (12), the applicator sheet (14), and the interposed adhesive (16), in combination, then become the coating plate (10) of the invention.

Figure 3:
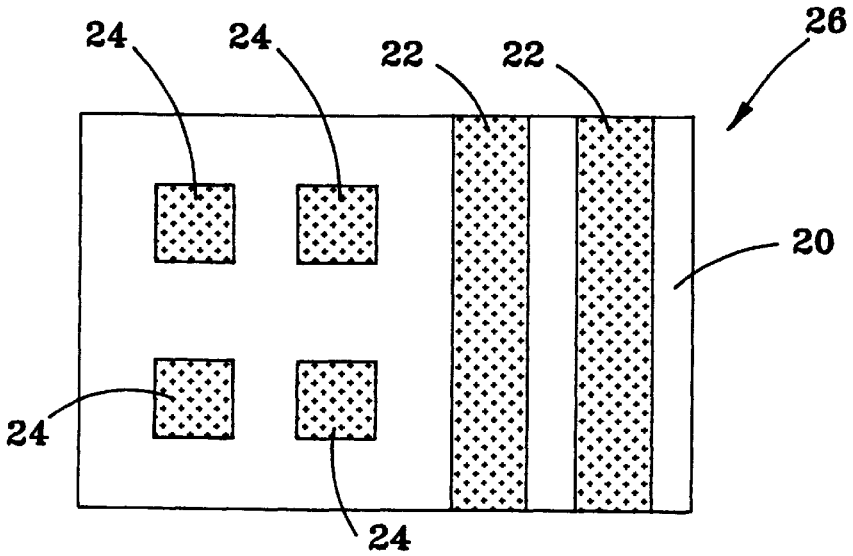
FIG. 3 is a top plan view of a pattern sheet (26) which has been marked to indicate the selected areas containing indicia (22)(24) relating to selected areas of printed material which are to be coated with a coating material.

Referring to FIG. 3, a pattern sheet (26) is shown which is utilized in the present method for preparing the coating plate (10) for coating printed material such as printed sheets or printed carton material in selected areas. The pattern sheet (26) comprises a base sheet (20) which may be formed of a plastic material, metal, paper or any other suitable base material. In fact, the printed material itself may be utilized as the pattern sheet (26). Spot coating indicia (22) and pattern coating indicia (24) are then applied to the base sheet (20) to indicate the selected areas of the printed material which are to be coated with the coating material. The indicia (22)(24) may be applied by painting, drawing, marking, or by applying colored strips or pieces of plastic material or paper by adhesion. Alternatively, a sheet of the printed material which is to be coated may itself be used as a pattern sheet (26), and further marked for clarity if desired.

Figure 4:
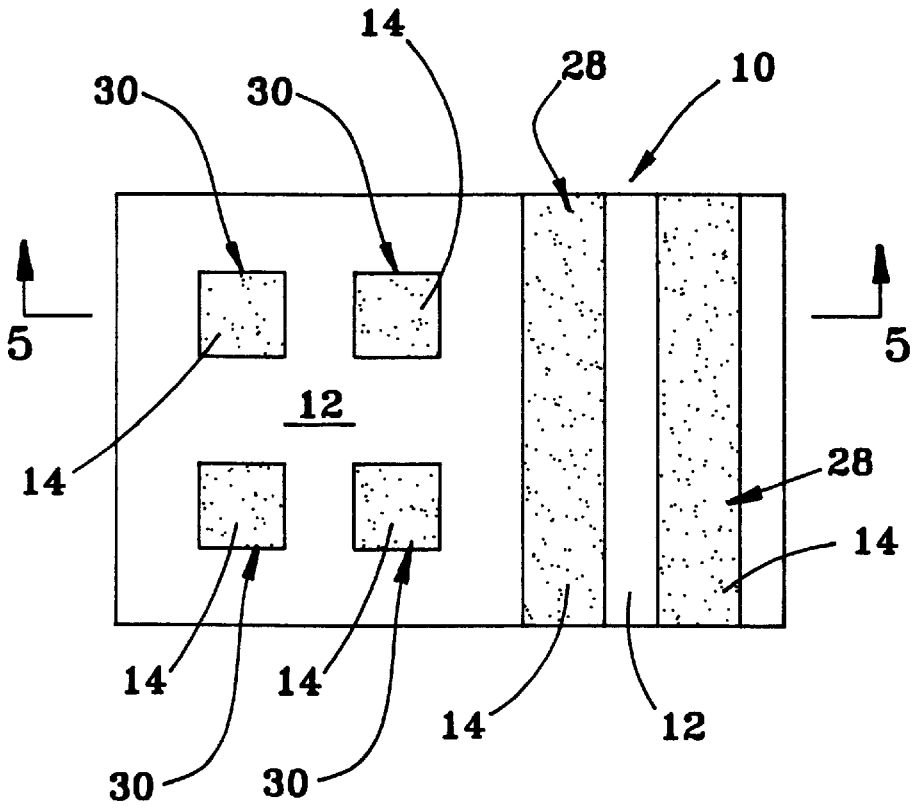
FIG. 4 is a top plan view of a processed coating plate (10) after the applicator sheet (14) has been cut according to the pattern of the indicia (22)(24) of FIG. 3, and wherein portions of the applicator sheet (14) have been removed, leaving only the portions (28)(30) representing the selected coating areas.
Figure 5:
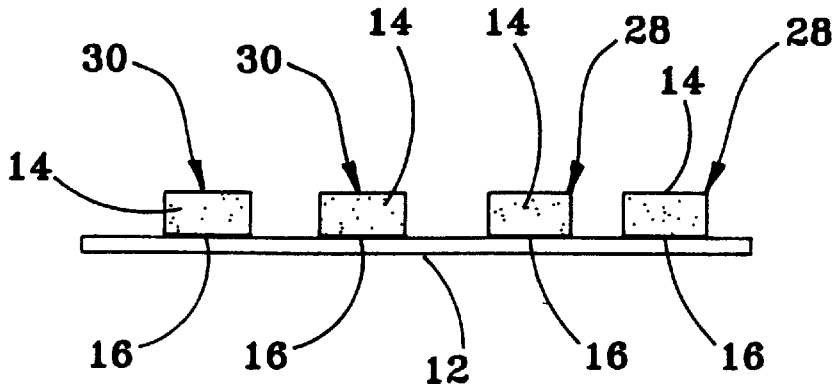
FIG. 5 is a cross-sectional view of the coating plate (10) shown in FIG. 4, taken at the line 5—5.

In carrying out the present method of preparing the coating plate (10) for coating select areas of printed material, the pattern sheet (26), after it has been properly provided with indicia (22)(24) indicating the selected areas of the printed material to be coated, is placed on a firm supporting surface. The coating plate (10) is then superposed or placed over the pattern sheet (26) in engagement therewith. Because the carrier sheet (12), the applicator sheet (14) and the adhesive (16) are each light-transmitting, that is, either transparent or translucent, the pattern indicia (22)(24) can readily be seen through the coating plate (10). The operator, while viewing the pattern indicia (22)(24) through the coating plate (10), utilizes cutting means such as a knife or razor blade to cut through the applicator sheet (14) along the lines of the pattern indicia (22)(24). He then lifts off the portions of the applicator sheet (14) surrounding the areas (28)(30), shown in FIGS. 4 and 5, which areas remain on the coating plate (10) for selective coating of the printed material. The coating plate 10 is then mounted on a coating cylinder. The coating material is then applied to the surface of the applicator sheet (14). Because of the high surface energy of the surfaces of the portions (28)(30) of the applicator sheet (14) which remain, these portions are readily able to retain a large amount of the coating material. When the coating material is subsequently applied to the surface of the printed sheet, the coating material is readily released and readily transferred to the selected areas of the printed material.

In the method described above for preparing the coating plate (10) for use in coating selected areas of printed material, a separate pattern sheet (26) containing the pattern indicia is placed under the coating plate (10) and the applicator sheet (14) is cut with a knife or razor blade as the operator views the indicia throught the light-transmitting coating plate (10). In an alternative embodiment, the pattern indicia are applied directly to the outer surface of the carrier sheet (12) by utilizing any of a number of well known methods. For example, the indicia may be applied by drawing lines on the surface of the carrier sheet (12). The indicia may also be painted onto the surface of the carrier sheet (12). This may be done by brushing, spraying, utilizing an air brush, or spraying paint through a template cut out in the areas where the indicia are to be provided. Alternatively, individual indicia formed of paper or plastic sheet-form material may be adhesively affixed to the surface of the carrier sheet (12). In still another method, the entire pattern sheet (26) may be adhesively affixed to the surface of the carrier sheet (12).

In an alternative method for preparing the present coating plate (10) for coating selected areas of printed material, instead of utilizing a hand-held knife or razor blade for mechanically cutting through the applicator sheet (14) without cutting through the carrier sheet (12), a Cad-Cam machine (Computer-Assisted Design-Computer Assisted-Machine) may be used utilizing a depth-programmable knife. This has the advantage of providing more precise cuts, taking less time when many cuts are needed, and of being able to make intricate cuts which would be difficult and/or time-consuming by hand.

When utilizing the Cad-Cam apparatus for cutting the applicator sheet (14), it is not necessary to place the pattern indicia underneath the coating plate (10), since the indicia are programmed into the computer. The computer feeds the desired X-Y axes information into the apparatus of the Cad-Cam which guides the knife. The use of the method of this form of the invention permits forms with many isolated images and with 100–400 knife cuts to be made in 15–30 minutes. This is much faster and more precise than could be done by hand.

Any of a large number of coating materials conventionally used in the art on lithographic presses may be utilized with the coating plate (10) of the present invention. A suitable commonly used coating material is a water based emulsion of an acrylic polymer or copolymer, containing approximately 40% solids. Another coating material commonly used is an aqueous emulsion of a polyurethane polymer, containing approximately 35% solids. Many other coating materials, including UV-coatings are also available in the art.

The present invention, comprising a novel coating plate (10) and the method for preparing the coating plate for use in coating selected areas of printed material, has many advantages over coating plates and methods for their preparation used in the prior art. The present coating plate (10) and its method of preparation significantly reduce material costs, typically by a factor of 10 to 1 to 20 to 1 over photochemically produced photopolymer plates commonly used in the art. The use of the present invention makes it possible for a printer to make a profit even on short runs. This is not possible with photopolymer plates. The result is that a printer can now solicit and run jobs he would formerly refuse when forced to use prior art equipment.

An additional benefit to the printer is that the present coating plate (10) may be processed for use in-plant, typically in a period of from ½ to 1 hour, and even less. The typical photopolymer plate which printers presently use must be purchased from a trade shop, typically with a 24 to 48 hour lead-time.

The material cost for the present coating plate (10) for use in spot/pattern coating for the popular 40" wide press is $50.00 or less. In contrast, the cost to the printer for a photopolymer plate which he typically must buy from a trade shop is $575.00 to $600.00, for the same size press.

An additional benefit to the printer occurs on occasion when the coating plate is damaged on-press. Typically, when utilizing photopolymer coating plates, this results in the $200.00 to $500.00 per hour press to be shut down for 24 hours or more, while waiting for the trade shop to fabricate and replace the photopolymer plate. In contrast, when utilizing the ;present coating plate, the printer's pre-press department can prepare the present coating plate in 15–60 minutes.

Long run plants cannot afford to have their press down 24 hours or more. Those plants which purchase photopolymer plates attempt to avoid this by buying 2 plates, in the hope that they will not have to use the spare plate. The cost comparison with regard to a 55" wide press is $2,500 for 2 photopolymer plates in contrast to $85 for a coating plate (10) according to the invention.

Another coating plate commonly used in the art is one which is prepared by making cutouts in a composite rubber/fabric coating blanket. The process of preparing the present coating plate (10) takes from ½ to 3 hours less time than that of the rubber/fabric coating blanket. Since the burden rate for the press is generally figured at $200 to $500 per hour, the savings resulting from the preparation of the present coating plate can amount to $100 to $400 per hour over that of the rubber/fabric coating blanket.

An additional advantage of the present coating plate (10) is that it can be prepared off-press in the printing plant's pre-press area by pre-press technician using standard pre-press tools and procedures. Typically, the present coating plate is press-side waiting for the previous job to come off. This elimination of press downtime can result in savings of $50,000 to $300,000 per year for the printer. Additionally, the plant derives extra profit from the additional jobs that are being run in place of the downtime of presses utilizing conventional coating plates.

The use of the present coating plate offers the printer additional advantages. A smoother, more uniform coating is applied to the entire coated surface, having attendant higher gloss and better scuff resistance and with less waste. Thus a superior product is obtained at no additional cost. The coating plate has greater durability, with attendant longer life. The coating plate is more smash-resistant when 3 or 4 sheets of paper, paperboard, or plastic get wrapped around the coating cylinder, with attendant less press downtime, less expense, and greater press productivity.

The present coating plate (10) is ecologically desirable and safe to workers and to the press mechanism. For the printer who may not be interested in higher gloss or better scuff resistance, but who would like greater productivity and faster throughput in the plant, these objects may be obtained with the present coating plate (10). Because the applicator sheet (14) of the coating plate (10) releases a greater proportion of the coating liquid which has been applied to it onto the surface of the printed material, less coating material need be applied to the applicator sheet (14) to obtain the same amount of coating material transferred to the printed surface than that which is applied by prior art plates utilizing a larger amount of applied coating liquid. A favorable consequence of the fact that a lesser amount of coating liquid need be utilized on the present coating plate is that less spray powder need be deposited on the printed material to prevent offsetting and blocking. In fact, some plants have been able to run their production with zero spray powder. This provides a highly desirable and beneficial result to the printer and the print purchaser. An additional advantage of the fact that a lesser amount of coating is required is that coating suppliers can now furnish water-based coating liquids with smaller amounts of volatile organic compounds such as isopropyl alcohol, or even with the complete elimination of volatile organic compounds. This is a highly desirable ecological benefit.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

Invention is claimed as follows:

1. A laminate coating body (10) adapted for coating selected areas of a printed sheet with a liquid coating material, said laminate coating body (10) comprising a carrier sheet (12) formed of a flexible light-transmitting material, and an applicator sheet (14) having inner and outer surfaces and securing means releasably affixing said inner surface of said applicator sheet to said carrier sheet (12), said applicator sheet (14) being formed of a flexible light-transmitting material which is severable by a cutting tool applied to and through the outer surface of the applicator sheet to a degree where portions of the applicator sheet can be pulled from the carrier sheet, at least the outer surface of said applicator sheet (14) being adapted to accept an amount of said coating material on its surface that can be effectively transferred to selected areas of a surface of said printed sheet during a coating process, said carrier and applicator sheets and said securing means being sufficiently transparent that coating area indicating indicia on a pattern sheet defining outer margins of areas of said pattern sheet to be stripped from said carrier sheet and placed beneath said carrier sheet is visible through the outer surface of said applicator sheet to guide said cutting tool along said outer margins of said areas so that the portions of the applicator sheet around said areas can be stripped from the carrier sheet.

2. A laminate coating body (10) according to claim 1, wherein said carrier sheet (12) has a thickness in the range from about 0.004" to about 0.020", and said applicator sheet (14) has a thickness in the range from about 0.015" to about 0.040".

3. A laminate coating body (10) according to claim 1, wherein said carrier sheet (12) is formed of a polyester polymer.

4. A laminate coating body (10) according to claim 3, wherein said polyester polymer is polyethylene terephthalate.

5. A laminate coating body (10) according to claim 1, wherein said applicator sheet (14) is formed of polyvinyl chloride.

6. A laminate coating body (10) according to claim 1, wherein said applicator sheet (14) is formed of polyethylene.

7. A laminate coating body (10) according to claim 1 wherein said outer surface of said applicator sheet (14) has a surface energy of at least about 38 dynes per square centimeter.

8. A laminate coating body (10) according to claim 1, wherein said securing means (16) is a pressure-sensitive adhesive.

9. A laminate coating body (10) according to claim 1 combined with said pattern sheet placed beneath said carrier sheet so that the indicia on said pattern sheet can be seen through the applicator sheet.

10. The laminate coating body of claim 1 wherein said applicator sheet can be severed with a manual force applied by the cutting tool, and said carrier sheet being of a strength not to be damaged by the pulling force applied while removing portions of the applicator sheet from the carrier sheet.

* * * * *